US011160380B1

(12) United States Patent
Chang

(10) Patent No.: US 11,160,380 B1
(45) Date of Patent: Nov. 2, 2021

(54) EASY ASSEMBLY OUTDOOR SOFA

(71) Applicant: Merry Yard International Enterprise Corp., New Taipei (TW)

(72) Inventor: Liang-Chi Chang, New Taipei (TW)

(73) Assignee: MERRY YARD INTERNATIONAL ENTERPRISE CORP., New Taipei (TW)

( * ) Notice: Subject to any disclaimer, the term of this patent is extended or adjusted under 35 U.S.C. 154(b) by 0 days.

(21) Appl. No.: 17/074,963

(22) Filed: Oct. 20, 2020

(51) Int. Cl.
*A47C 4/02* (2006.01)
*A47C 17/02* (2006.01)
*A47C 1/14* (2006.01)

(52) U.S. Cl.
CPC ..... *A47C 4/027* (2013.01); *A47C 1/14* (2013.01); *A47C 17/02* (2013.01)

(58) Field of Classification Search
CPC ..... A47C 4/027; A47C 4/02; A47C 4/024; A47C 17/02; A47C 1/14
USPC ..... 403/375, 381; 297/440.15, 440.14, 297/440.23
See application file for complete search history.

(56) References Cited

U.S. PATENT DOCUMENTS 643,552 A * 2/1900 Squires ..... F16B 12/46 403/381
1,273,968 A * 7/1918 Whedon ..... A47C 4/02 297/440.15
2,333,073 A * 10/1943 Mueller ..... A47C 4/02 297/440.23
2,895,753 A * 7/1959 Fentiman ..... E04B 1/1903 403/381
4,504,168 A * 3/1985 Miller ..... A47B 13/021 403/353
2020/0390243 A1* 12/2020 Nardi ..... A47C 5/10

FOREIGN PATENT DOCUMENTS

DE 29506919 U1 * 8/1995 ..... A47C 7/626

* cited by examiner

*Primary Examiner* — Milton Nelson, Jr.
(74) *Attorney, Agent, or Firm* — Bacon & Thomas, PLLC

(57) ABSTRACT

An easy assembly outdoor sofa is disclosed, comprising such components of a base and a backrest (or armrest). The plane of the base extends horizontally to form a seat, and the periphery of the base is formed with a bar portion having oval section. The bar portion extends downward to form a frame, wherein the bottom of the backrest (or armrest) extends laterally to form an L-shaped connecting portion. A C-shaped opening is formed at the intersection part between the bottom and the L-shaped connecting portion. The C-shaped opening is to receive the oval bar portion of the base; as a characteristic feature, both the upper edge and lower edge of the bar portion of the base are configured with a positioning tenon, and corresponding to the positioning tenon, the L-shaped connecting portion is configured with a positioning mortise with larger width. Moreover, the base and the L-shaped connecting portion are configured with fixing holes matching each other.

3 Claims, 4 Drawing Sheets

EASY ASSEMBLY OUTDOOR SOFA

BACKGROUND OF INVENTION

1. Field of the Invention

The present invention relates to the furniture field, in particular outdoor furniture, and more particularly to an outdoor sofa made up of integrally formed modular components.

2. Description of Related Art

FIG. 4a, FIG. 4b, FIG. 4c and FIG. 4d of WO2019/162782 patent disclosed the mounting method of the backrest (or armrest) on the seat. The body of the backrest is arranged substantially parallel to the seat above it, causing the slit of the claw to be in correspondence and alignment with the bar (FIG. 4a). At this point the backrest is moved towards the seat causing the bar to become partially housed in the bore through the slit (FIG. 4b).

By driving the backrest into rotation around the bar, making the body lift up towards the upright position, taking advantage of the width of the slit, the upper portion, and in particular the relative upper edge is propped against the front (or inner) side of the bar. Assisted by the controlled flexion of the material, the lower portion overlaps the lower part of the bar (FIG. 4c), until snapping into the mounted position, in which the bar and the bore become tight-fit coupled, bringing into perfect match of the two respective oval sections (external profile of the bar, inner profile of the bore).

In the final position (FIG. 4d) the projection of the lower portion of the member is forced on the bar exerting a contrast to the rotation opposite to that of assembly and therefore acting as a stabilizing factor. The wing has also come into contact with the lower face of the seat.

Said modular kit can be assembled very easily and is indeed a valuable design. However, although the assembly can be accomplished through the friction between the components, it is not firm and stable. In other words, a push in the opposite direction against the backrest (or armrest) will cause the wing fitted on the lower face of the seat to fall apart from the fitting position. Therefore, if a child playing outdoors collides with the backrest (or armrest) when running or jumping and causes the wing fitted on the lower face of the seat to fall apart, it may result in an unexpected injury.

SUMMARY OF THE INVENTION

The main objective of the present invention is to provide an improvement on WO2019/162782 patent. Apart from simplified method to assemble the kit, a positioning and fixing structure is adopted to firmly fix the backrest (or armrest) on the base, so as to eliminate the potential problems in connection with WO2019/162782 patent.

Therefore, the present invention provides an easy assembly outdoor sofa, comprising a base and a backrest (or armrest). The plane of the base extends horizontally to form a seat, the periphery of the base is formed with a bar portion. The bar portion extends downward to form a frame, wherein the bottom of the backrest (or armrest) extends laterally to form an L-shaped connecting portion. A C-shaped opening is formed at the intersection part between the bottom and the L-shaped connecting portion. The C-shaped opening is to receive the oval bar portion of the base; both the upper edge and lower edge of the bar portion of the base are configured with a positioning tenon, and corresponding to the positioning tenon, the L-shaped connecting portion is configured with a positioning mortise with larger width. Moreover, the base and the L-shaped connecting portion are configured with fixing holes matching each other.

Based on said structural characteristics, the width of the positioning mortise on the two ends of the C-shaped opening is larger than the width of the positioning tenon on the bar portion, so that the positioning tenon can move between the first position on one side of the positioning mortise and the second position on the other side.

Based on said structural characteristics, the positioning tenon of the bar portion is located at the second position of the positioning mortise, for example, the position where the fixing hole of the bar portion and the fixing hole of the L-shaped connecting portion are aligned.

DETAILED DESCRIPTION OF THE INVENTION

Figure 1:
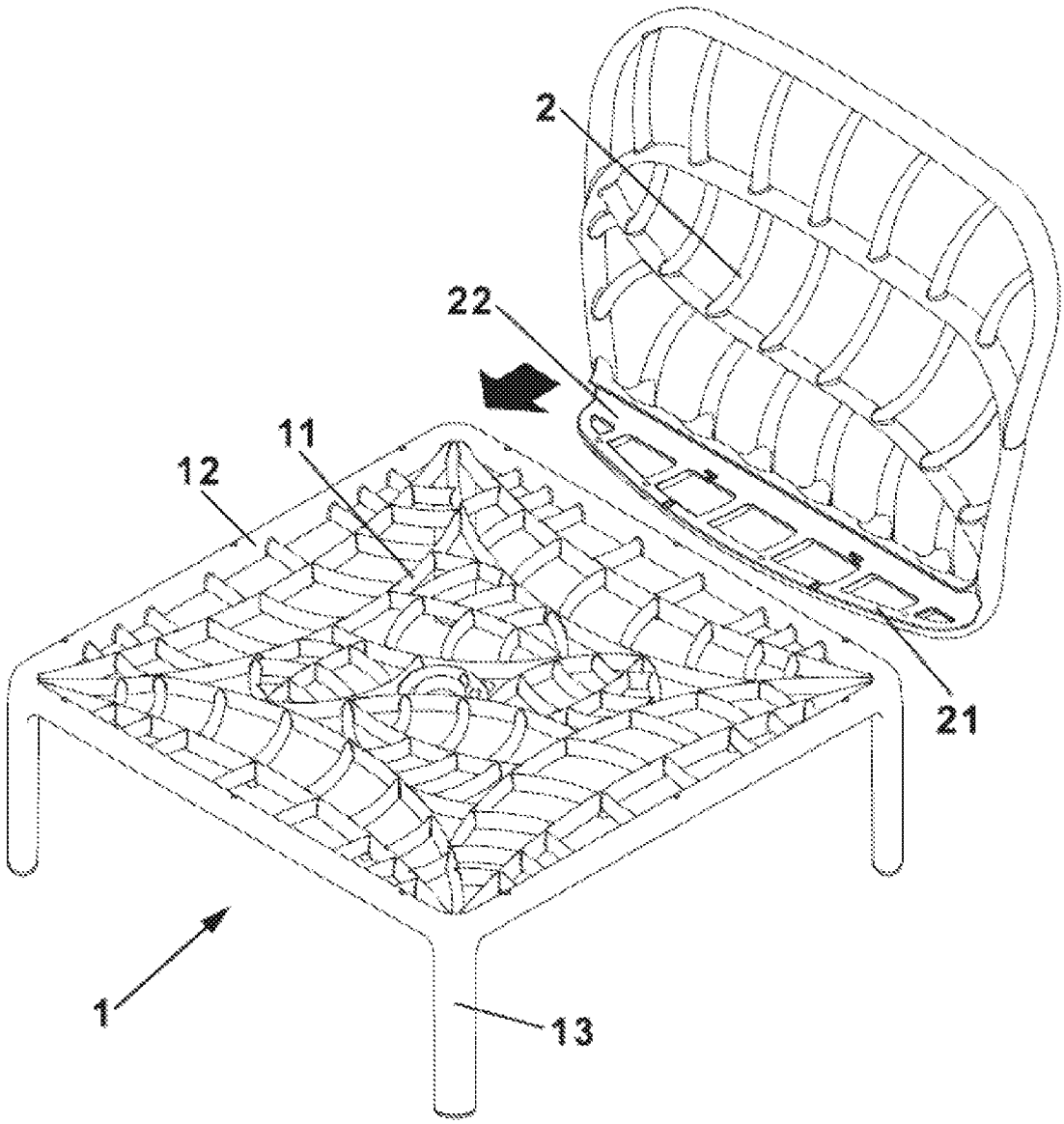
FIG. 1 is an exploded view of the overall appearance of the present invention.

To help those skilled in the art understand the objective of the present invention, a preferred embodiment of the present invention is described in detail with reference to the accompanying drawings:

With reference to FIG. 1 to FIG. 6, the easy assembly outdoor sofa according to the invention comprises such components as a base 1 and a backrest (or armrest) 2. The plane of the base 1 extends horizontally to form a seat 11, the periphery of the base is formed with a bar portion 12 with oval section, and the bar portion extends downward to form a frame 13.

Figure 2:
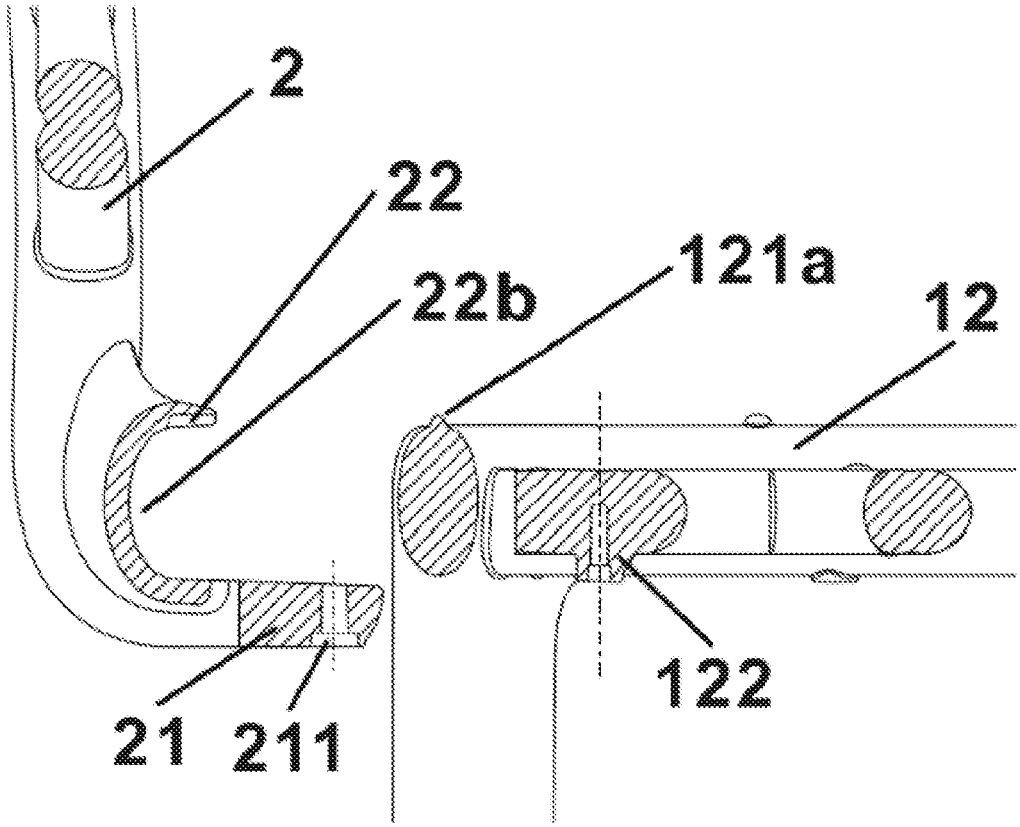
FIG. 2 is a partial exploded schematic view of the present invention.
Figure 3:
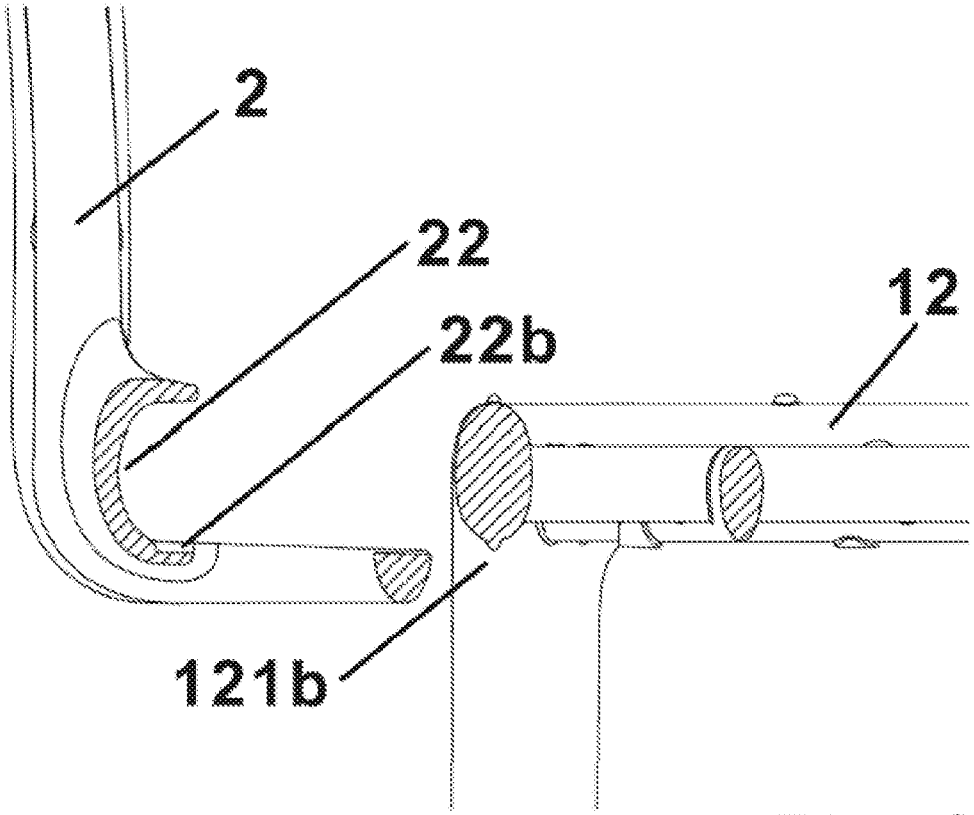
FIG. 3 is another partial exploded schematic view of the present invention.
Figure 4:
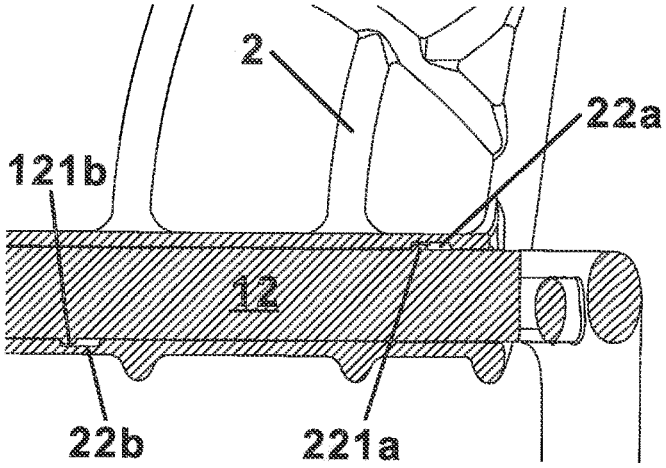
FIG. 4 is a partial combined schematic view of the present invention.
Figure 5:
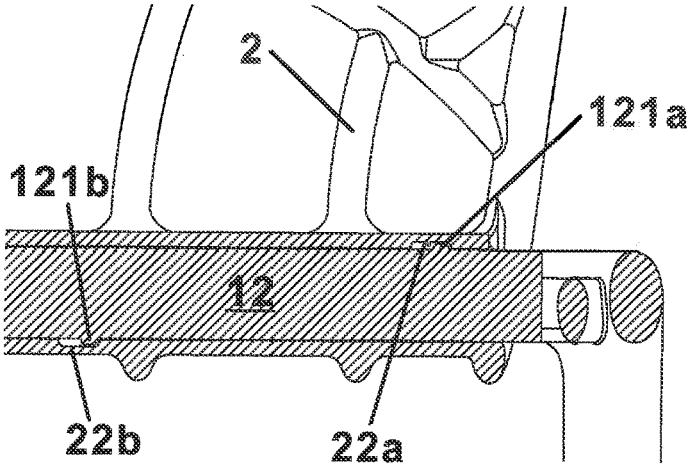
FIG. 5 is another partial combined schematic view of the present invention.
Figure 6:
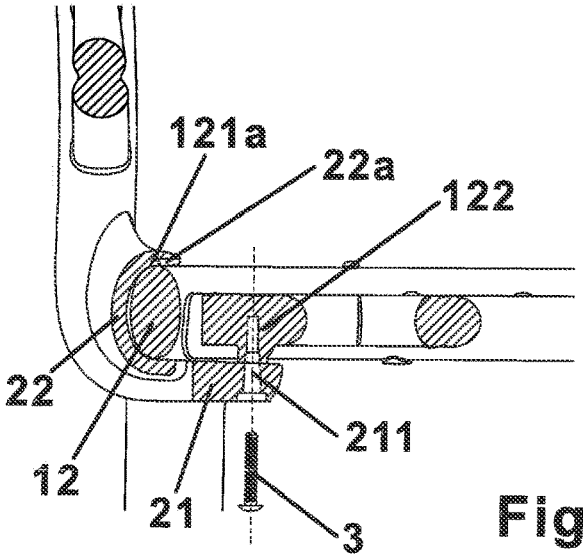
FIG. 6 is a further partial combined schematic view of the present invention.

The bottom of the backrest (or armrest) 2 extends laterally to form an L-shaped connecting portion 21. A C-shaped opening 22 is formed at the intersection between the bottom and the L-shaped connecting portion. When the backrest (or armrest) 2 is pushed toward the base 1 in the direction indicated by the arrow in FIG. 1, the C-shaped opening 22 will receive the oval bar portion 12;

As shown in FIG. 2 and FIG. 3, to form the positioning and fixing structure of the present invention, the upper edge and lower edge of the bar portion are respectively provided with a positioning tenon 121*a*, 121*b*, and corresponding to the positioning tenon, the two ends of the C-shaped opening 22 are configured with a positioning mortise 22*a*, 22*b*. The width of the positioning mortise is larger than the width of the positioning tenon, so that the positioning tenon can move between the first position (as shown in FIG. 4) on one side of the positioning mortise (see FIG. 4) and the second position (see FIG. 5) on the other side. When said positioning tenon 121*a*, 121*b* moves from the first position of the positioning mortise 22*a*, 22*b* shown in FIG. 4 to the second position of the positioning mortise 22*a*, 22*b* shown in FIG. 5, the positioning is completed. Referring to FIG. 6, the fixing structure of the present invention is accomplished through the provision of matching fixing holes 122, 211 configured on the bar portion 12 and the L-shaped connecting portion 21. When said positioning tenon 121*a*, 121*b* is at the second position of the positioning mortise 22*a*, 22*b*, i.e., the position where the fixing hole 122 on the bar portion and the fixing hole 211 of the L-shaped connecting portion are aligned, the positioning is completed. Then, a fixing component such as a screw 3 is used to firmly fix the backrest (or armrest) 2 on the base 1.

In contrast to said WO2019/162782 patent having the problem of unstable fixation due to the assembly of the base and the backrest (or armrest) only by the friction between the components, the present invention provides a positioning and fixing structure to ensure firm combination of the backrest (or armrest) and the base, avoiding separation and offering better stability.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

The invention claimed is:

1. An easy assembly outdoor sofa, comprising:

a base;

a seat; and a backrest or armrest, wherein a plane of said base is extended horizontally to form the seat, the periphery of the base has a bar portion with an oval section, and said bar portion extends downward to form a frame, wherein a bottom of said backrest or armrest extends laterally to form an L-shaped connecting portion, a C-shaped opening is formed at the intersection between the bottom and the L-shaped connecting portion, and said C-shaped opening receives the bar portion, wherein both an upper edge and a lower edge of the bar portion of the base are configured with a positioning tenon, and corresponding to the positioning tenon, the L-shaped connecting portion is configured with a positioning mortise with larger width, and wherein the base and the L-shaped connecting portion are configured with fixing holes matching each other.

2. The easy assembly outdoor sofa defined in claim 1, wherein the positioning mortise is on two ends of the C-shaped opening and a width of the positioning mortise on the two ends of said C-shaped opening is larger than a width of the positioning tenon on the bar portion, so that the positioning tenon can move between a first position on one side of the positioning mortise and a second position on another side of the positioning mortise.

3. The easy assembly outdoor sofa defined in claim 2, wherein, said positioning tenon of the bar portion is located at the second position of the positioning mortise, so that the fixing hole of the bar portion and the fixing hole of the L-shaped connecting portion are aligned.

* * * * *